US008360291B2

(12) United States Patent
Kameda

(10) Patent No.: US 8,360,291 B2
(45) Date of Patent: Jan. 29, 2013

(54) STAPLE CARTRIDGE

(75) Inventor: Futoshi Kameda, Chuo-ku (JP)

(73) Assignee: Max Co., Ltd., Tokyo (JP)

( * ) Notice: Subject to any disclaimer, the term of this patent is extended or adjusted under 35 U.S.C. 154(b) by 289 days.

(21) Appl. No.: 12/786,937

(22) Filed: May 25, 2010

(65) Prior Publication Data

US 2010/0301092 A1 Dec. 2, 2010

(30) Foreign Application Priority Data

May 28, 2009 (JP) ..... P.2009-128858

(51) Int. Cl.
*B25C 5/16* (2006.01)

(52) U.S. Cl. ..... 227/120; 227/127; 227/131; 227/135; 227/136; 227/82; 227/85; 206/338; 206/340

(58) Field of Classification Search ..... 227/120, 227/127, 131, 135–136, 82, 85; 206/338, 206/340

See application file for complete search history.

(56) References Cited

U.S. PATENT DOCUMENTS

| | | | | |
|---|---|---|---|---|
| 6,974,068 | B2 * | 12/2005 | Mochizuki et al. | 227/131 |
| 2006/0261123 | A1 * | 11/2006 | Kishi et al. | 227/120 |

FOREIGN PATENT DOCUMENTS

| | | |
|---|---|---|
| JP | 8-71951 | 3/1996 |
| JP | 2005-74565 | 3/2005 |
| WO | WO 02/053326 A2 | 7/2002 |

* cited by examiner

*Primary Examiner* — Sameh H. Tawfik
*Assistant Examiner* — Michelle Lopez
(74) *Attorney, Agent, or Firm* — Drinker Biddle & Reath LLP

(57) ABSTRACT

A staple cartridge is provided with: a refill which houses in a wound manner a staple sheet formed by coupling a plurality of straight staples and includes a guide passage for carrying out the staple sheet; and a cartridge body which includes a feeding passage for guiding the staple sheet carried out from the refill via the guide passage to a position of driving out by the driver. The guide passage is communicated with the feeding passage when the refill is attached to the cartridge body, and the refill is attached to and detached from the cartridge body from a direction different from a direction along which the guide passage and the feeding passage are communicated.

4 Claims, 10 Drawing Sheets

STAPLE CARTRIDGE

This application claims priority from Japanese Patent Application No. 2009-128858, filed on May 28, 2009, the entire contents of which are hereby incorporated by reference.

FIELD OF THE INVENTION

The present invention relates to a staple cartridge and, more particularly, relates to a staple cartridge including a refill capable of housing in a wound manner a staple sheet formed by coupling a plurality of straight staples and including a cartridge body for guiding the staple sheet to operation positions of a forming plate and a driver plate.

DESCRIPTION OF RELATED ART

In a related art, a staple cartridge is configured by a refill for housing a staple sheet formed by coupling a plurality of straight staples and a cartridge body to which the refill can be attached. The staple cartridge can be loaded to an electric stapler. When the electric stapler is driven in a state that the staple cartridge is loaded to the electric stapler, the staple sheet within the refill is guided to a forming position through a feeding passage formed in the cartridge body. The staple thus guided to the forming position of the feeding passage is formed in a U-shape by a forming plate and is driven toward a bundle of papers by a driver plate in a state that the leg portions of the staple are directed to the bundle of paper. After the bundle of papers is penetrated by the leg portions, the leg portions are bent inside by a clincher mechanism provided within a table or by being guided to a groove portion of a concave board (clincher) formed at the table, to thereby complete the binding procedure of the bundle of papers by means of the staple.

In the case where there remains no staple within the refill, the refill is detached from the cartridge body and a new refill is attached thereto, whereby staples can be supplemented or exchanged easily, However, when the refill is detached from the cartridge body in a state that there remains a staple sheet within the refill, the staple sheet existing in the feeding passage of the cartridge body remains in a divided state. As a result, there may arise a case that the feeding passage is clogged due to the staple sheet thus remained. Thus, there is proposed a structure for preventing the phenomenon that the refill can be detached easily from the cartridge body in the state that the staple sheet remains in the refill (See JP-A-8-71951 and JP-A-2005-74565, for example).

According to the staple cartridge disclosed in JP-A-8-71951, in a case where stacked (laminated) staple sheets exist in the housing portion of a refill, an engaging portion for engaging the refill with a cartridge body is locked by a lock link. When there remains no staple sheet in the housing portion, since the lock link is unlocked, the locked state of the engaging portion released, so that the refill can be detached from the cartridge body.

The staple cartridge disclosed in JP-A-2005-74565 is provided with a kind of link mechanism portion (actuator) having a lock member swingable with respect to a lower surface of a cartridge body. In a state where a staple sheet wound and housed is guided to a feeding passage from a refill, when an abutment portion provided at the one end of the lock member abuts against the staple sheet, an engagement projection provided at the other end of the lock member engages with a movable plate, whereby an engagement member (engagement plate) for engaging the refill with the cartridge body is locked. In a state where the staple sheet does not exist in the feeding passage, the abutment portion enters into the feeding passage, whereby the lock member is swung to thereby release the locking state of the engagement member. When locking state of the engagement member is released, it is possible to detached the refill from the cartridge body.

However, in JP-A-8-71951, since the configuration can be realized in a refill for housing stacked (laminated) staple sheets, it is not easy to employ a refill for winding and housing a staple sheet.

On the other hand, in JP-A-2005-74565, although the method can be applied to a refill for winding and housing a staple sheet, since it is necessary to mount the link mechanism (actuator) on the lower surface of the cartridge body, the configuration becomes complicated and the cost of the staple cartridge may be increased.

It is considered to employ a method of directly pushing a staple sheet existing in the feeding passage without using the link mechanism to thereby engage the refill with the cartridge body by using a reaction responding to the pushing. However, according to such the method of directly pushing the staple, the staple may be deformed by the pushing force and so the binding procedure may not be performed smoothly.

SUMMARY OF INVENTION

Illustrative aspects of the present invention provide a staple cartridge which can realize a mechanism wherein a refill can not be easily detached from a cartridge body in a case that a staple sheets exists in a feeding passage and also which can attach and detach the refill with respect to the cartridge body with a simple configuration without deforming a staple in a state that the refill is attached to the cartridge body.

According to a first aspect of the invention, a staple cartridge is provided with: a refill which houses in a wound manner a staple sheet formed by coupling a plurality of straight staples and includes a guide passage for carrying out the staple sheet; and a cartridge body which includes a feeding passage for guiding the staple sheet carried out from the refill via the guide passage to a position of driving out by the driver. The guide passage is communicated with the feeding passage when the refill is attached to the cartridge body, and the refill is attached to and detached from the cartridge body from a direction different from a direction along which the guide passage and the feeding passage are communicated.

Other aspects and advantages of the invention will be apparent from the following description, the drawings and the claims.

BRIEF DESCRIPTION OF THE DRAWINGS

FIGS. 1A and 1B are perspective views showing an electric stapler and a staple cartridge according to an exemplary embodiment, wherein FIG. 1A shows a state before loading the staple cartridge into the electric stapler and FIG. 1B shows a state where the staple cartridge is loaded into the electric stapler;

FIGS. 4A to 4D are diagrams showing a state where the refill according to the exemplary embodiment is attached to the cartridge body, wherein FIG. 4A is a perspective view thereof, FIG. 4B is a sectional view cut along A-A in FIG. 4A, FIG. 4C is an enlarged sectional view of a portion B of FIG. 4B, and FIG. 4D is an enlarged sectional view of a portion C of FIG. 4B;

FIGS. 6A and 6B are diagrams showing a state where the refill according to the exemplary embodiment is swung with respect to the cartridge body, wherein FIG. 6A shows a side view thereof and FIG. 6B shows a sectional view seen from a side direction thereof;

FIGS. 7A to 7D are diagrams showing a state where the refill according to the exemplary embodiment is attached to the cartridge body, wherein FIG. 7A shows a side view thereof, FIG. 7B shows a sectional view seen from a side direction thereof, FIG. 7C shows an enlarged sectional view of a portion D of FIG. 7B, and FIG. 7D shows an enlarged sectional view of a portion E of FIG. 7B; and FIGS. 8A and 8B are diagrams showing an example of another configuration of a refill and a cartridge body according to the exemplary embodiment, wherein FIG. 8A is a perspective view separately showing the refill and the cartridge body, and FIG. 8B is a perspective view showing a state where the refill is attached to the cartridge body.

DETAILED DESCRIPTION OF EXEMPLARY EMBODIMENTS

Hereinafter, a staple cartridge according to the exemplary embodiment will be explained in detail with reference to accompanying drawings.

Figure 1A:
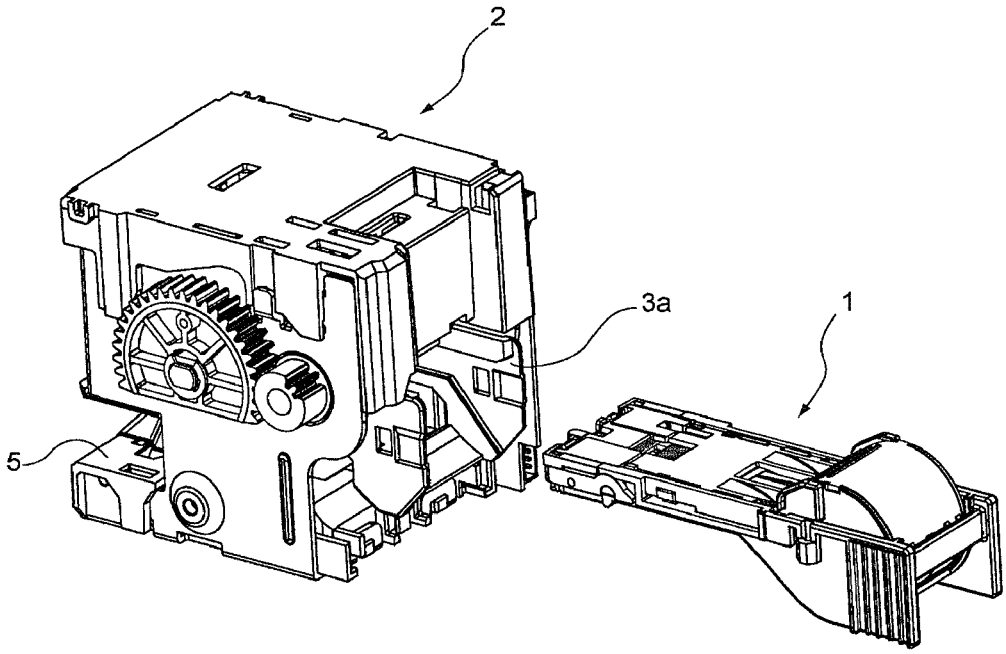
Figure 1B:
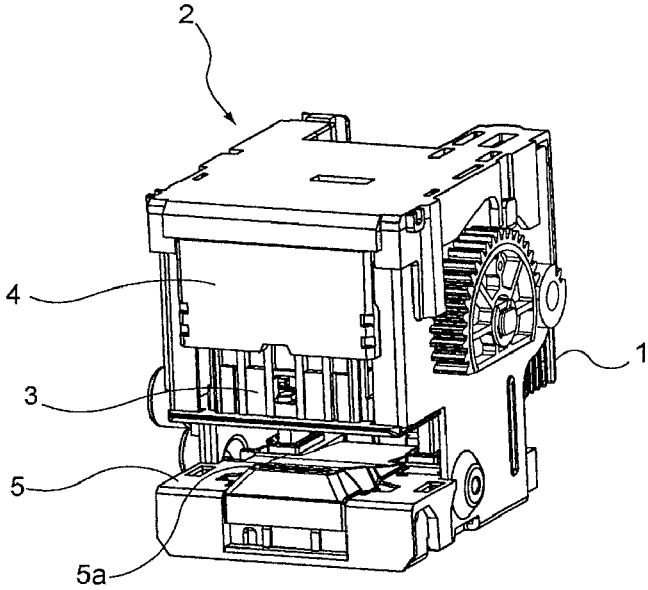
Figure 2:
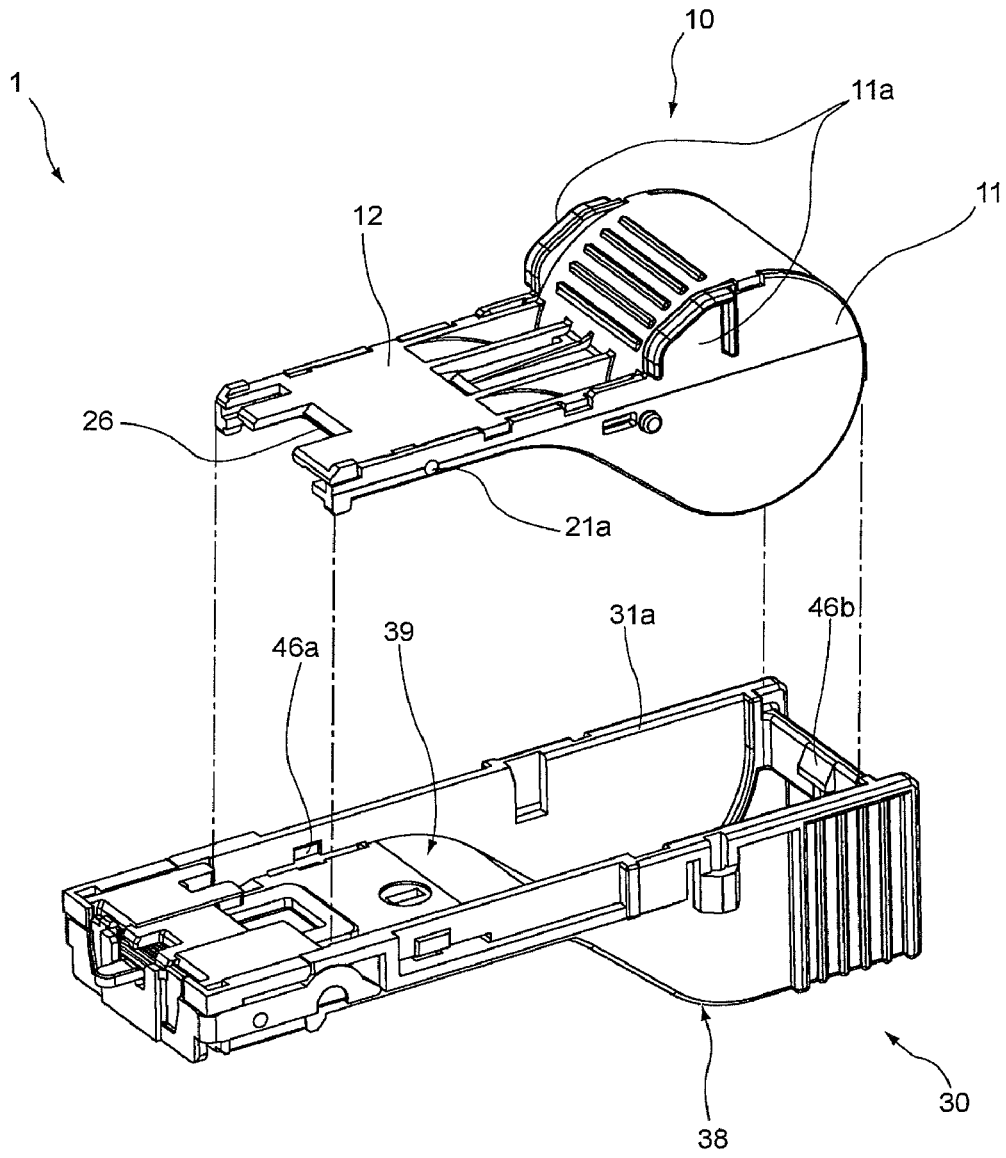
FIG. 2 is a first perspective view separately showing a refill and a cartridge body according to the exemplary embodiment.
Figure 3:
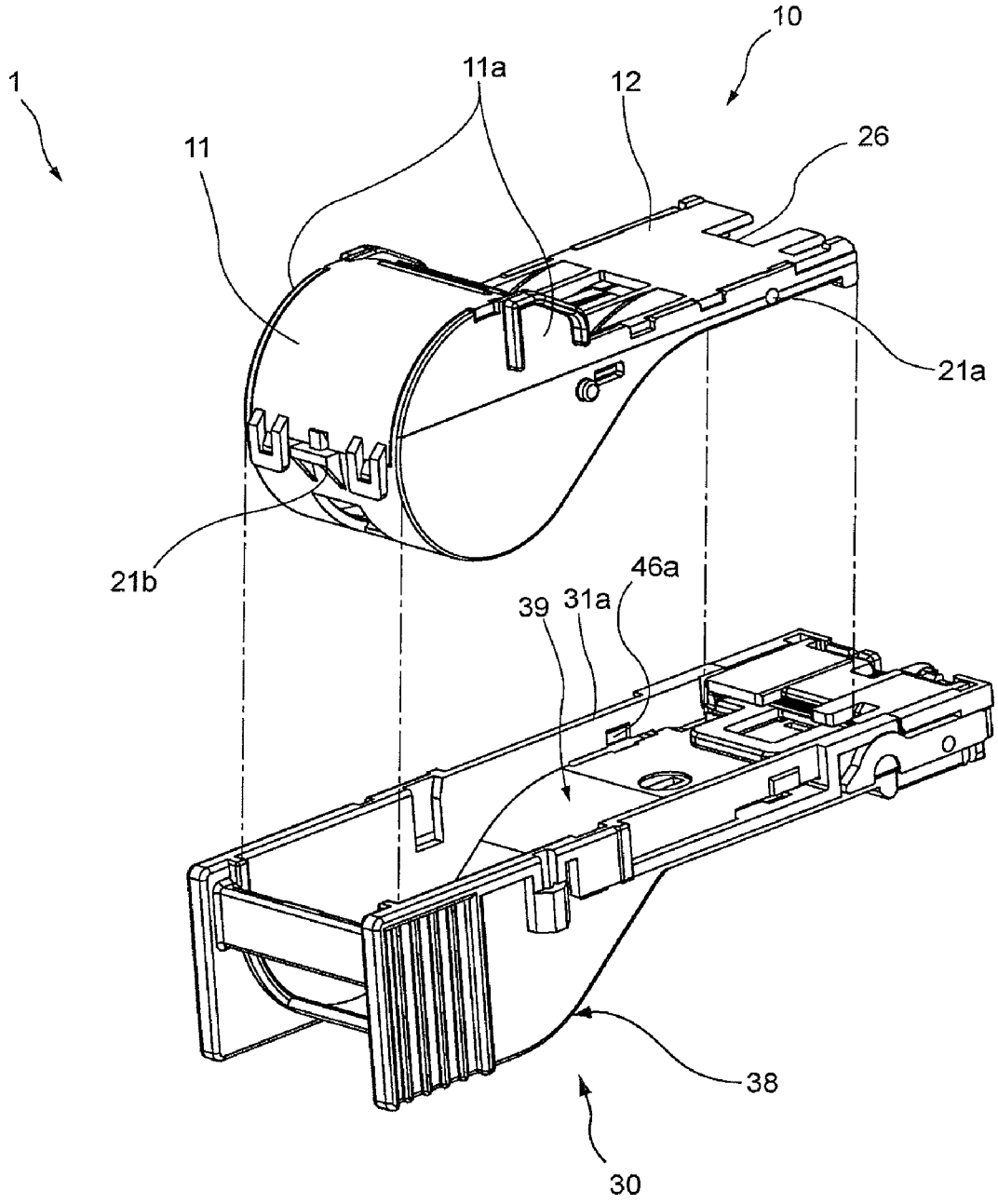
FIG. 3 is a second perspective view separately showing the refill and the cartridge body according to the exemplary embodiment.

FIGS. 1A and 1B are perspective views showing the staple cartridge and an electric stapler to which the staple cartridge is loaded.

The electric stapler 2 according to the exemplary embodiment is incorporated into a copying machine or a multifunction printer (MFP) etc. so as to automatically bind a bundle of copied or printed papers.

The electric stapler 2 includes a magazine 3, a driver unit 4, a table and a motor (not shown).

The magazine 3 is provided at a center portion of the electric stapler 2 and acts to hold a staple cartridge 1. An opening portion 3*a* for guiding the staple cartridge 1 inserted from a rear side to the magazine 3 is formed at a rear face of the electric stapler 2. The staple cartridge 1 is loaded into the magazine 3 by inserting a front side (cartridge introduction portion side described later) of the staple cartridge 1 into the opening portion 3*a*.

The driver unit 4 is disposed above the magazine 3 and held so as to keep a given distance from the magazine 3 via a not-shown gear. The driver unit 4 is provided with a forming plate (not shown) for bending a straight staple disposed at a front end of a staple sheet in a U-shape in its section and a driver (not shown) for driving the staple thus bent by the forming plate toward the table 5.

The table 5 is provided at a lower portion on a front side of the stapler. A concave board (clincher) 5*a* for bending leg portions of the staple driven toward the table 5 by the driver unit 4 is formed at a position opposing to the driver on an upper face of the table 5. The concave board 5*a* has groove portions for deforming the leg portions toward the inside by utilizing a pushing force of the driver applied just beneath thereof in the case where the staple is driven by the driver.

The motor is disposed within the electric stapler 2 and driven under the control of a control portion of a copying machine or a multifunction printer. A not-shown link mechanism is provided at an output shaft of the motor. Each of the driver unit 4 and the magazine 3 is moved reciprocally to upper and lower directions by the link mechanism driven in accordance with the motor.

When the motor is driven in a state that a bundle of papers is placed on the table 5, the magazine 3 is moved down toward the table 5 in accordance with the driving of the motor, so that the bundle of papers is sandwiched between the magazine 3 and the table 5. Thereafter, when the driver unit 4 is driven to lower the forming plate, the staple disposed at a forming position is bent in a U-shape and is pushed toward the bundle of papers in accordance with the lowering of the driver, so that the leg portions of the staple thus bent penetrate the bundle of papers.

Thereafter, when the staple is further pushed by the driver, the end portions of the leg portions are protruded from the bundle of papers while a crown of the staple are pressed against the bundle of papers, whereby the end portions of the leg portions thus protruded are deformed toward the inside at the concave board 5*a*. When the penetration of the leg portions into the bundle of papers and the deformation thereof are completed by the pushing operation of the driver and the binding of the bundle of papers by the staple is completed, the driver unit 4 is moved upward and the magazine 3 is moved toward a direction separating from the table 5 (that is, moved upward) to thereby terminate the binding procedure of the bundle of papers.

Next, the construction of the staple cartridge 1 will be explained. As shown in FIGS. 2 to 7D, the staple cartridge 1 is configured by a refill 10 and a cartridge body 30.

Figure 4A:
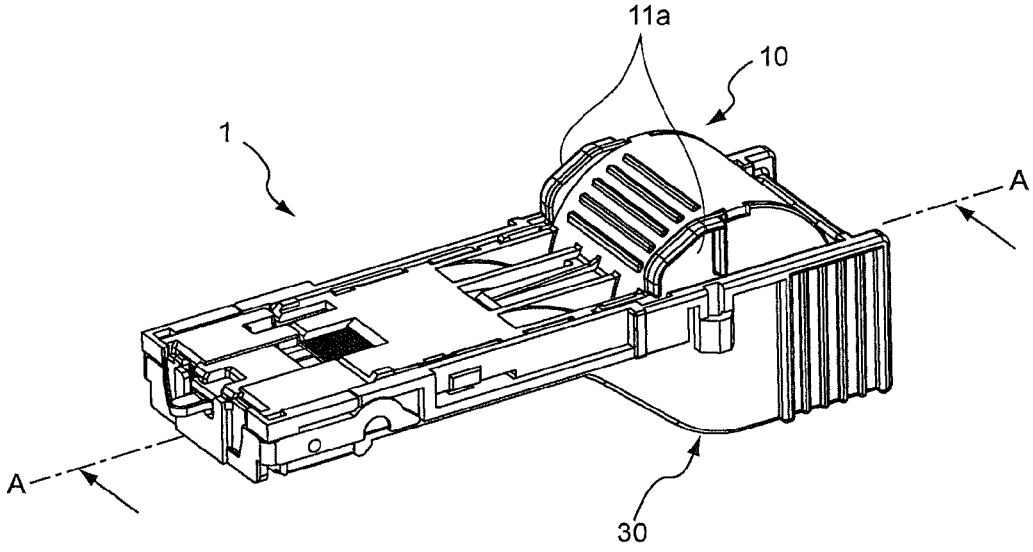
Figure 4B:
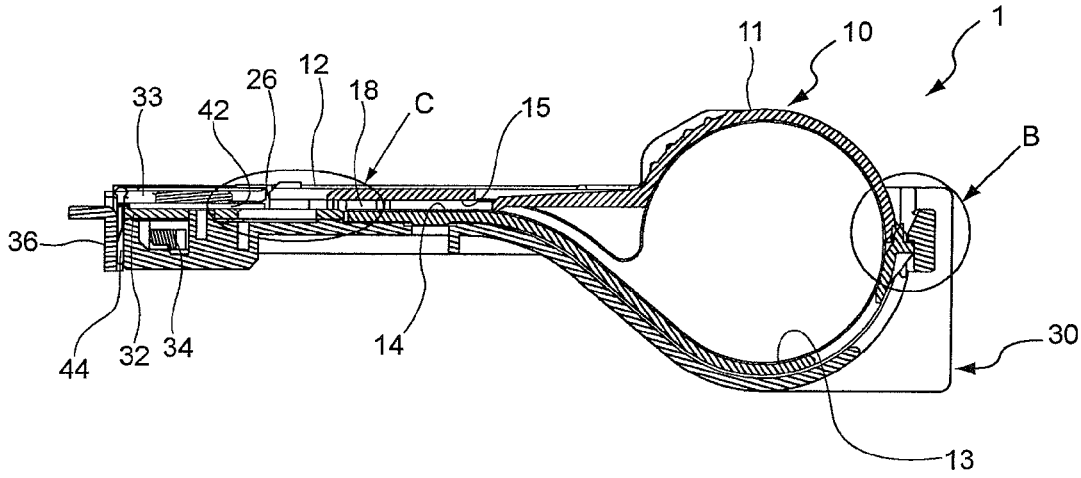
Figure 4C:
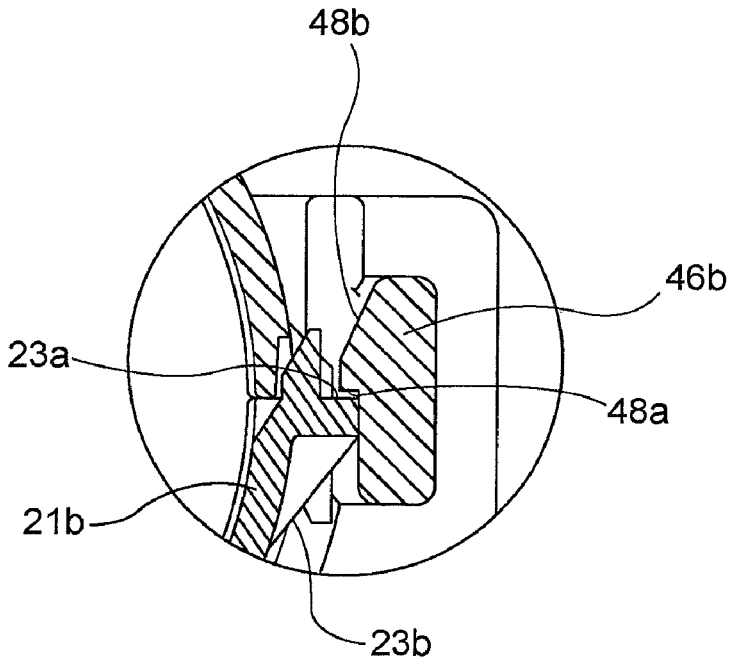
Figure 4D:
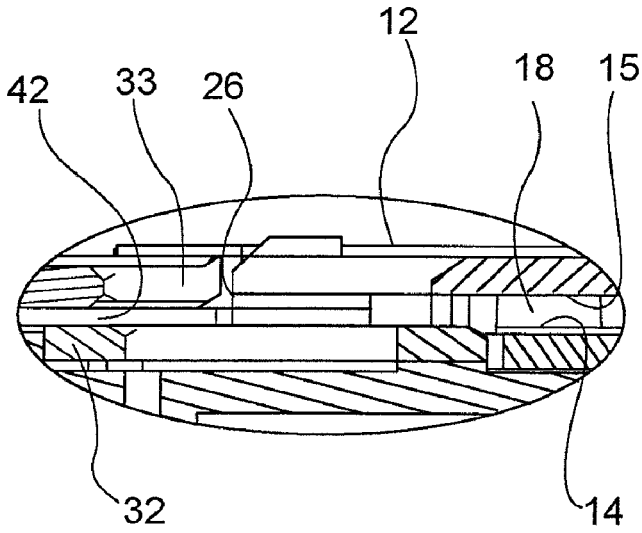
Figure 6A:
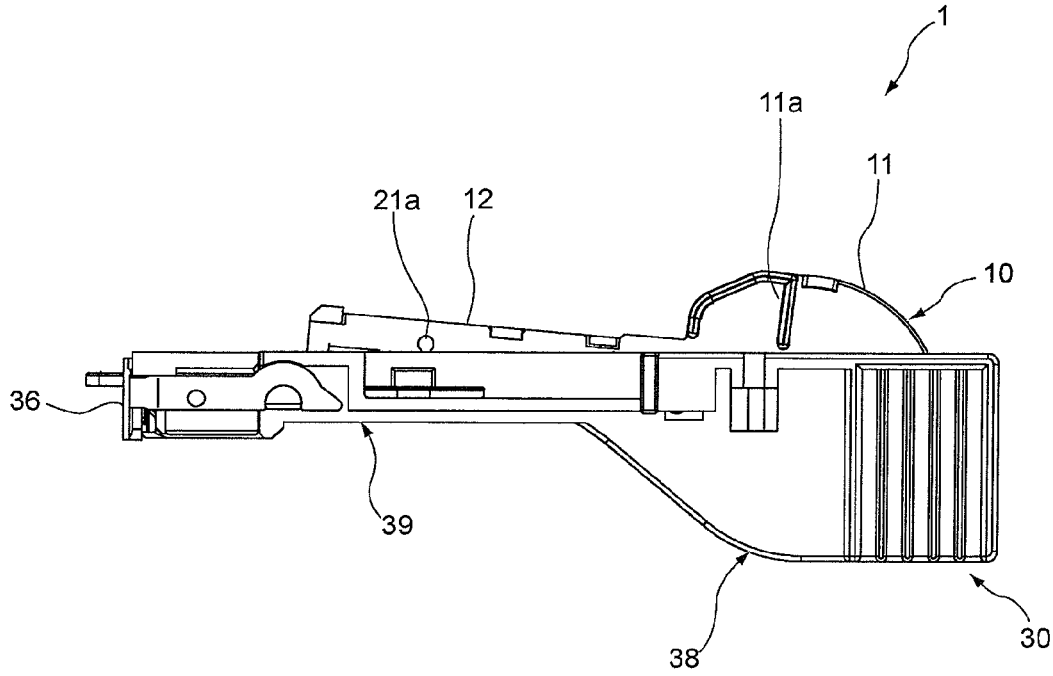
Figure 6B:
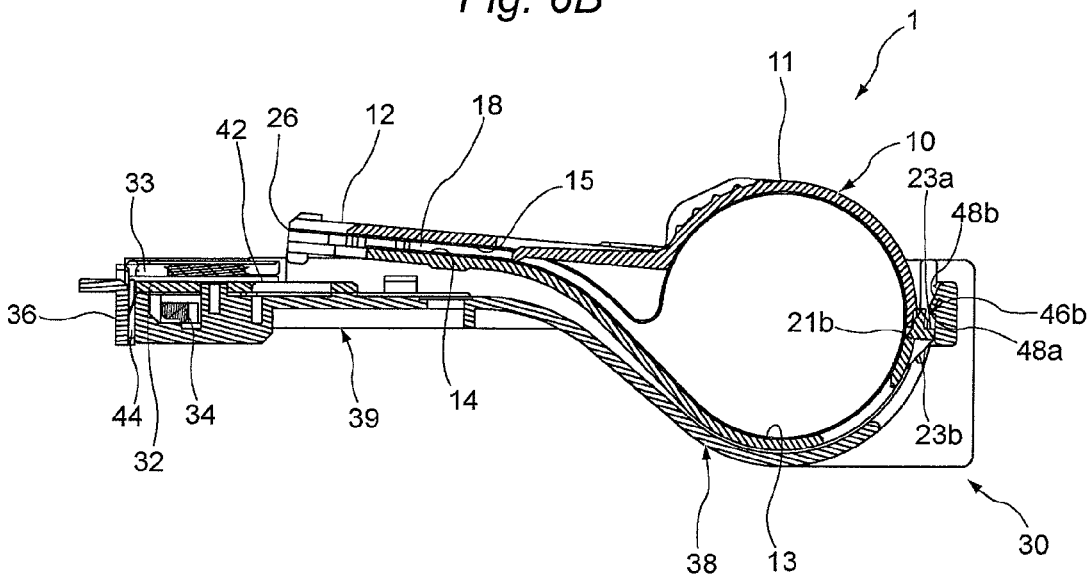

The refill 10 can house therein a staple sheet 16 formed by coupling a plurality of straight staples (see FIG. 7B) in a wound state. The refill 10 includes a refill housing portion 11 which is expanded upward and downward to form a substantially circular shape in its section and a refill introduction portion 12 which is extended to a side direction from the refill housing portion 11. As shown in FIG. 4B and FIG. 6B, a lower inner face of the refill introduction portion 12 is formed by a guide lower face 14 formed a smooth curved face extended from a tip end position of the refill introduction portion 12 to a lower inner face 13 of the refill housing portion 11. The upper inner face of the refill introduction portion 12 is formed by a guide upper face 15 which is formed by a smooth curved face extended from the tip end position of the refill introduction portion 12 to the refill housing portion 11 so as to correspond to the curved state of the guide lower face 14 in a state of securing a passage (hereinafter called a guide passage 18) for guiding the staple sheet 16 to the tip end of the refill introduction portion 12 from the refill housing portion 11 with respect to the guide lower face 14.

Further, an opening portion 26 capable of passing the staple sheet 16 therethrough is formed at the tip end portion of the refill introduction portion 12. Thus, when the staple sheet 16 is guided to the guide passage formed by the guide upper face 15 and the guide lower face 14 and the end portion of the staple sheet 16 is carried out from the opening portion 26, the staple sheet 16 housed in the refill housing portion 11 can be sent to the cartridge body 30 continuously and smoothly.

Further, a rear portion refill engagement portion (detachable member) 21*b* for performing the engagement with the cartridge body 30 is provided at a rear end portion of the refill 10 (a rear end portion of an outer periphery of the refill housing portion 11). Furthermore, front portion refill engagement portions 21*a* for performing the engagement with the cartridge body 30 are provided at both side face portions on a front side of the refill 10 (an outer side face portions of the refill introduction portion 12). The explanation will be made later with respect to the rear portion refill engagement portion 21*b* and the front portion refill engagement portions 21*a*.

Figure 5:
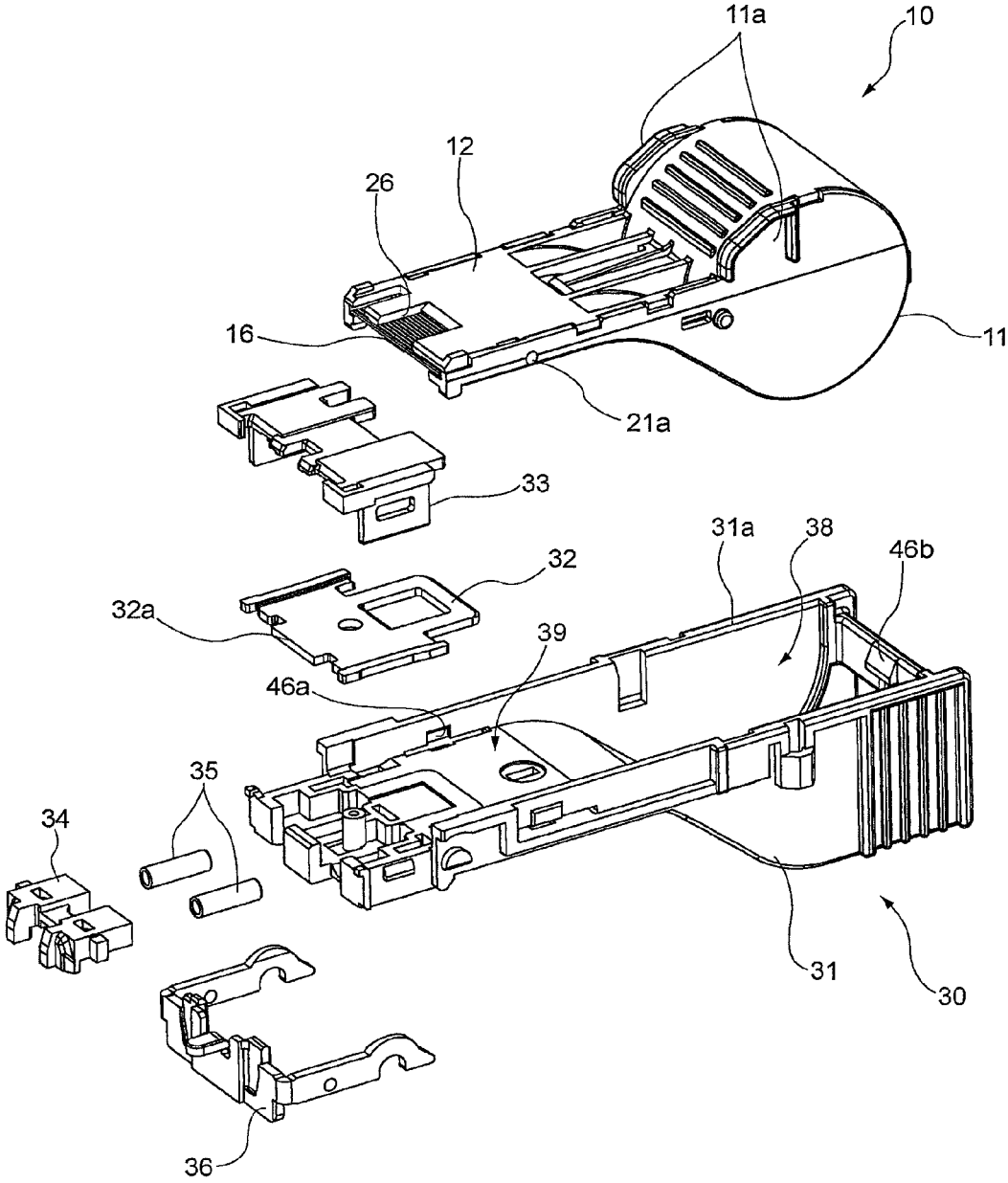
FIG. 5 is a developed perspective view showing the staple cartridge according to the exemplary embodiment.

As shown in FIG. 5, the cartridge body 30 includes a main body portion 31 for housing the refill 10, a staple guide 32 provided at a tip end portion of the main body portion 31, a staple guide pressing portion 33, a pusher 34, a pusher spring 35 and a face plate 36.

The main body portion 31 has a housing configuration with an opened upper face for performing the attachment/detachment of the refill 10 and is entirely molded by composite resin. To be concrete, the main body portion 31 includes a cartridge housing portion 38 for housing the refill housing portion 11 of the refill 10 via an upper opening portion 31*a* being opened and a cartridge introduction portion 39 for housing the refill introduction portion 12. The cartridge housing portion 38 is provided with a concave portion formed by a curved face corresponding to the expanded configuration of the lower outer side of the refill housing portion 11, and the inner face of the cartridge housing portion 38 formed from the concave portion to the cartridge introduction portion 39 is provided with a gentle curved face corresponding to the lower shape of the refill 10. The cartridge housing portion 38 is continued to the cartridge introduction portion 39 by these continuous curved faces.

The pusher 34, the pusher spring 35, the staple guide 32 and the staple guide pressing portion 33 are disposed in an elevationally laminated manner at a front portion of the cartridge introduction portion 39, namely, at the front side position of the refill introduction portion 12 in a state that the refill 10 is attached to the cartridge body 30.

A feeding passage 42 for guiding the staple sheet 16 is formed between the staple guide 32 and the staple guide pressing portion 33 which are disposed in the laminated manner. The passage 18 and the feeding passage 42 are connected via the opening portion 26 formed at the tip end surface of the refill introduction portion 12 in the state that the refill 10 is housed within the cartridge body 30.

A center portion 32*a* is formed protrusively at a tip end portion of the staple guide 32 in a manner that side portions thereof are notched. The forming plate is disposed above the tip end portion of the staple guide 32. When the forming plate is driven so as to be moved downward, both side portions of the staple located at the notched portions of the staple guide 32 are bent downward respectively by the forming plate to form the leg portions, whilst the area of the staple located at the center portion 32*a* maintains a horizontal state to form the crown, whereby the staple is deformed in a U-shape in its section.

The pusher 34 disposed on a lower side of the staple guide 32 is provided so as to be movable in front and rear directions and maintains a state of being always biased in the forward direction by the pusher spring 35 located on a rear side of the pusher 34.

The staple having the U-shape in its section, in which the leg portions are formed by the forming plate in the aforesaid manner, is placed in a state that the leg portions thus bent locate on the front face side of the pusher 34. Thus, the staple disposed on the front face side of the pusher 34 is pushed in the forward direction by the pusher 34 based on a biasing force of the pusher spring 35.

The face plate 36 covering the front face of the main body portion 31 of the cartridge body 30 is provided at the front face of the pusher 34. The face plate 36 is attached to the main body portion 31 in a state that a small gap is secured with respect to the front portion of the cartridge introduction portion 39. The gap formed by the main body portion 31 and the face plate 36 is used as a driving-out passage 44 for guiding the driver. In the case of performing the driving-out operation (lower movement) by the driver, the driver penetrates the feeding path 42 and enters into the driving-out passage 44.

The staple bent in the U-shape by the forming plate is moved, due to the pushing operation of the pusher 34 in the forward direction, to a position locating at a front end of the feeding passage 42 and facing to the driving-out passage 44. The staple thus pushed out to the driving-out passage 44 is pushed out (driven out) on the table 5 side by the driving operation of the driver, whereby the leg portions bent to the lower side penetrate the bundle of papers due to the driving operation to thereby perform the binding procedure.

As shown in FIGS. 2 to 7D, the cartridge body 30 is provided with a rear portion cartridge engagement portion (detachable member) 46*b* engaging with the rear portion refill engagement portion 21*b* of the refill 10 and front portion cartridge engagement portions 46*a* respectively engaging with the front portion refill engagement portions 21*a* of the refill 10. Next, the explanation will be made as to the front portion refill engagement portions 21*a*, the rear portion refill engagement portion 21*b*, the front portion cartridge engagement portions 46*a* and the rear portion cartridge engagement portion 46*b*.

Each of the front portion refill engagement portions 21*a* is a hemispherical projection provided so as to protrude to the side direction with respect to the outer side face of the refill introduction portion 12. On the other hand, each of the front portion cartridge engagement portions 46*a* is a concave portion provided at the inner side face of the cartridge introduction portion 39 and is configured in a manner that each of the front portion refill engagement portion 21*a* is fit into the corresponding front portion cartridge engagement portion 46*a* when the refill 10 is housed in the cartridge body 30.

Since the main body portion 31 of the cartridge body 30 is molded by the composite resin, when the refill 10 is housed in the cartridge body 30, the side face of the cartridge introduction portion 39 bends slightly by the hemispherical projection of the front portion refill engagement portions 21*a*, so that each of the front portion refill engagement portions 21*a* can be guided to the corresponding front portion cartridge engagement portions 46*a*.

Further, since each of the front portion refill engagement portions 21*a* has the hemispherical shape, in the process of being fitted into each of the front portion cartridge engagement portions 46*a* and also in the process of detached from the front portion cartridge engagement portions 46*a*, the front portion refill engagement portion 21*a* can be fitted into and detached from the front portion cartridge engagement portion smoothly without causing such a phenomenon that the projection portion of the hemispherical shape is caught by the side face etc. of the cartridge introduction portion 39.

On the other hand, the rear portion refill engagement portion 21*b* is a projection portion provided at the rear end portion of the refill 10 so as to protrude backward. The upper face of the projection portion is formed by an engaging flat face 23*a* formed so as to be substantially in parallel (that is, so as to maintain the horizontal state) to an extending direction of the feeding passage in the state that the refill 10 is housed in the cartridge body 30. The side face of the projection portion is formed by a tapered face 23*b* forming a slanted face.

The rear portion cartridge engagement portion 46*b* is formed by a projection portion capable of engaging with the projection portion of the rear portion refill engagement portion 21*b*. The lower face of the projection portion is formed by an engaging flat face 48*a* which abuts against the engaging flat face 23*a* of the rear portion refill engagement portion 21*b* to thereby restrict an upper movement of the refill 10 in the state that the refill 10 is housed in the cartridge body 30. The side face of the projection portion is formed by a tapered face 48*b* is slidably made in contact with the tapered face 23*b* of the rear portion refill engagement portion 21*b*. The tapered face 48*b* guides the projection portion of the rear portion refill engagement portion 21*b* to a lower direction so as to be lower than the rear portion cartridge engagement portion 46*b* in the case of housing the refill 10 in the cartridge body 30.

In this manner, the rear portion refill engagement portion 21*b* and the rear portion cartridge engagement portion 46*b* include the tapered surfaces 23*b*, 48*b* respectively for guiding the rear portion refill engagement portion 21*b* to the lower side of the rear portion cartridge engagement portion 46*b* at the time of housing the refill 10 into the cartridge body 30 and further include the engaging flat surfaces 23*a*, 48*a* respectively which abut and engage to each other in the state that the refill 10 is housed in the cartridge body 30 to thereby prevent the refill 10 from being disengaged from the cartridge body 30 and moving upward. Thus, in the case of attaching the refill 10 to the cartridge body 30, the refill 10 can be easily fitted into the cartridge body 30 and the attached refill 10 can be prevented from being unintentionally disengaged from the cartridge body 30.

In the case of attaching the refill 10 to the cartridge body 30, since the main body portion 31 of the cartridge body 30 is molded by the composite resin, the tapered face 48*b* of the rear portion cartridge engagement portion 46*b* is slidably made in contact with the tapered face 23*b* of the rear portion refill engagement portion 21*b* and so the rear portion cartridge engagement portion 46*b* bends slightly. Due to such the bending, the rear portion refill engagement portion 21*b* moves over the tapered face 48*b* and is guided to the lower direction of the rear portion cartridge engagement portion 46*b*.

In the case of attaching the refill 10 formed in this manner to the cartridge body 30, the refill 10 is moved to the opening direction of the cartridge body (direction facing the upper opening portion 31*a* for housing the refill 10), that is, an elevational direction (attachment/detachment direction) and fitted into the cartridge body 30. Thus, the rear portion refill engagement portion 21*b* engages with the rear portion cartridge engagement portion 46*b* and each of the front portion refill engagement portions 21*a* engages with each of the front portion cartridge engagement portions 46*a*, whereby the refill 10 fitted into the cartridge body 30 is fixed to thereby complete the attachment procedure.

In the case of attaching the refill 10 to the cartridge body 30, it is not necessary to simultaneously perfume the engagement between the rear portion refill engagement portion 21*b* and the rear portion cartridge engagement portion 46*b* and the engagement between the front portion refill engagement portion 21*a* and the front portion cartridge engagement portion 46*a*. The cartridge housing portion 38 for housing the refill housing portion 11 is provided with the concave portion formed by the curved face corresponding to the expanded configuration of the lower outer side of the refill housing portion 11, and the inner face of the cartridge housing portion formed from the concave portion to the cartridge introduction portion 39 is configured by the gentle curved face corresponding to the lower shape of the refill 10.

Figure 7A:
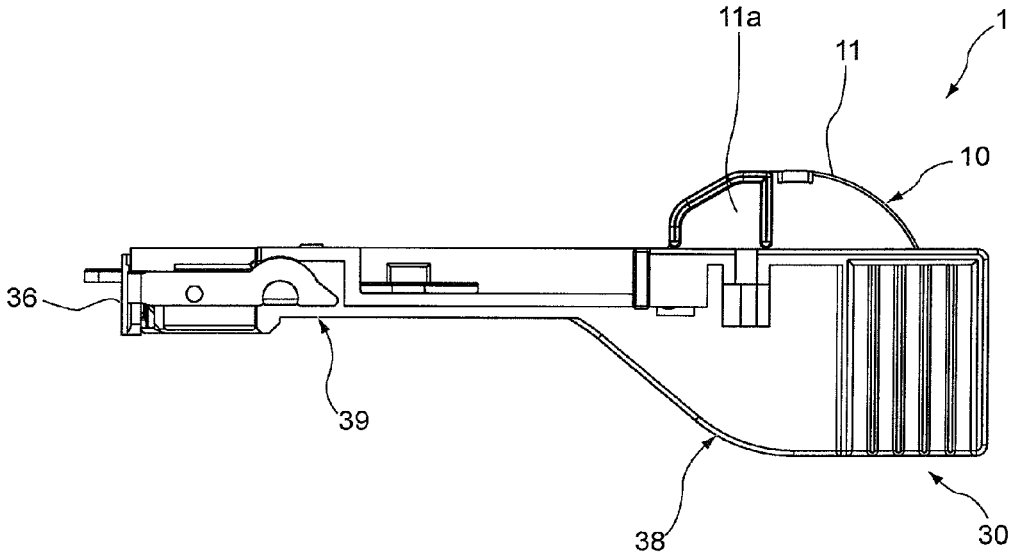
Figure 7B:
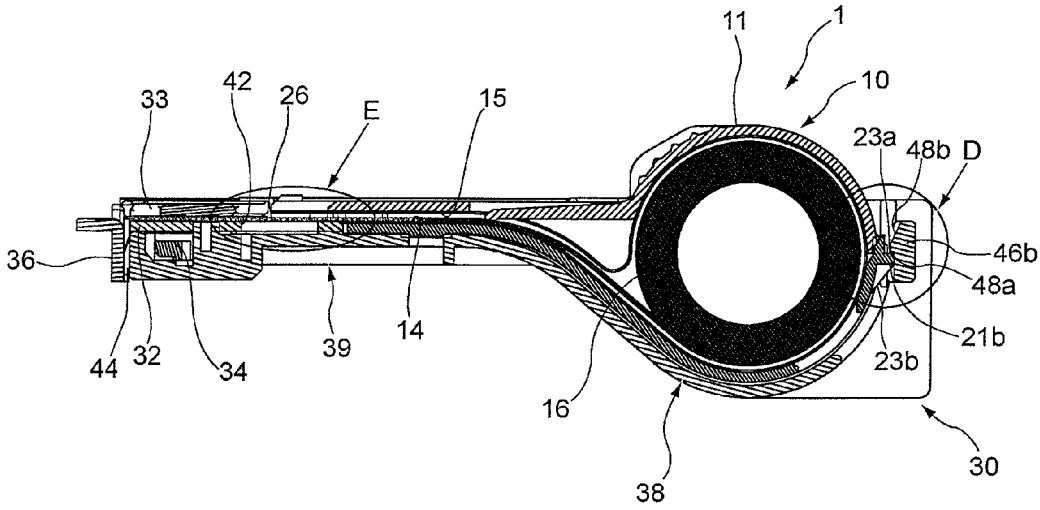
Figure 7C:
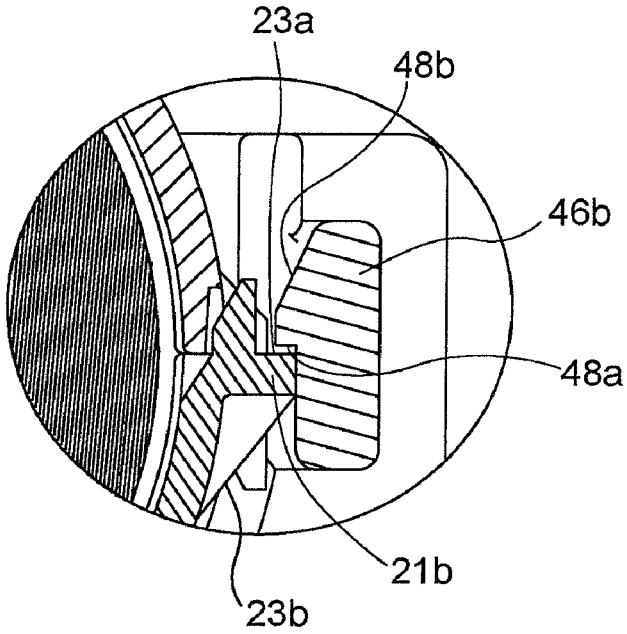
Figure 7D:
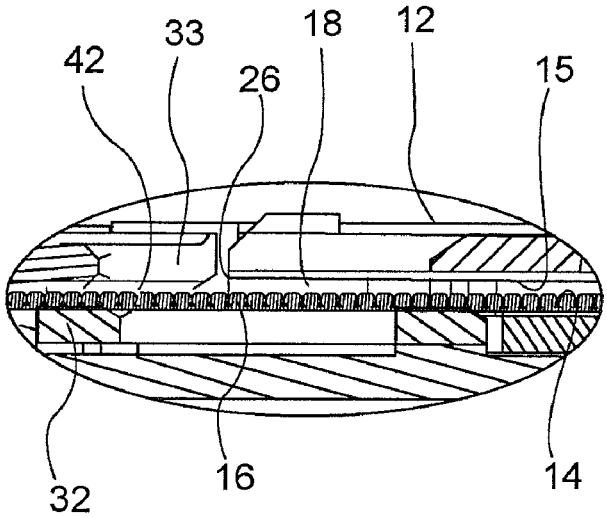

Thus, in the case of attaching the refill 10 to the cartridge body 30, firstly when the refill housing portion 11 of the refill 10 is housed within the cartridge housing portion 38 of the cartridge body 30, the refill housing portion 11 is made swingable in accordance with the curved face of the cartridge housing portion 38. Thus, firstly, as shown in FIGS. 6 A and 6B, the rear portion refill engagement portion 21*b* is guided to the lower side of the rear portion cartridge engagement portion 46*b* to thereby be placed in a state that the engaging flat face 23*a* of the rear portion refill engagement portion 21*b* and the engaging flat face 48*a* of the rear portion cartridge engagement portion 46*b* can be abutted to each other in accordance with the swinging state of the refill housing portion 11. Thereafter, as shown in FIGS. 7A and 7B, when the refill introduction portion 12 is swung and moved toward the cartridge introduction portion 39 of the cartridge body 30, it becomes possible to engage the front portion refill engagement portion 21*a* and the front portion cartridge engagement portion 46*a* to each other.

On the other hand, in a state that the tip end of the refill introduction portion 12 is abutted against the staple guide 32 and the staple guide pressing portion 33 provided at the cartridge introduction portion 39 to thereby position the tip end of the refill 10, the refill housing portion 11 of the refill 10 can be lowered toward the cartridge housing portion 38 of the cartridge body 30 and housed therein. In this manner, when the refill housing portion 11 is housed within the cartridge housing portion 38 after positioning the tip end portion of the refill 10, the refill 10 can be prevented from wobbling at the time of attaching the refill 10. Further, when the refill housing portion 11 is moved down toward the cartridge housing portion 38, each of the front portion refill engagement portions 21*a* and each of the front portion cartridge engagement portions 46*a* are engaged to each other and then the rear portion refill engagement portion 21*b* moves over the tapered face 48*b* of the rear portion cartridge engagement portion 46*b* and is guided to the lower direction of the rear portion cartridge engagement portion 46*b*, whereby the rear portion refill engagement portion 21*b* and the rear portion cartridge engagement portion 46*b* can be engaged to each other.

In this manner, when the staple cartridge 1, in which the refill 10 is attached to the cartridge body 30, is loaded into the electric stapler 2 and the binding procedure of the electric stapler 2 is started, the staple sheet housed in the refill housing portion 11 of the refill 10 is transferred to the feeding passage 42 formed between the staple guide 32 and the staple guide pressing portion 33 via the opening portion 26 of the refill introduction portion 12.

Next, the explanation will be made as to the case of detaching the refill 10 from the cartridge body 30. In a state that there is no staple sheet 16 in the passage to the feeding passage 42 from the guide passage 18 via the opening portion 26 of the refill housing portion 11, for example, in a state that all the staple sheets 16 housed within the refill 10 are used and so there remains no staple sheet, in the case of detaching the refill 10 from the cartridge body 30, the engagement between the front portion refill engagement portion 21*a* and the front portion cartridge engagement portion 46*a* can be released by pinching and slightly pulling the upper side face 11*a* of the refill housing portion 11 upward.

As explained above, the engagement between the front portion refill engagement portion 21*a* and the front portion cartridge engagement portion 46*a* is performed in a manner that the hemispherical projection of the refill introduction portion 12 protruded in the side direction is fitted into the recess portion provided at the inner side face of the cartridge introduction portion 39. Thus, the engagement between the front portion refill engagement portion 21*a* and the front portion cartridge engagement portion 46*a* can be released easily as compared with the engagement between the rear portion refill engagement portion 21*b* and the rear portion cartridge engagement portion 46*b* which is realized by such the configuration that the engaging flat faces 23*a*, 48*a* abut to each other.

Thus, since the engagement between the rear portion refill engagement portion 21*b* and the rear portion cartridge engagement portion 46*b* is unlikely released as compared with the engagement between the front portion refill engagement portion 21*a* and the front portion cartridge engagement portion 46*a*, when the upper side face 11*a* of the refill housing portion 11 is pinched and slightly pulled upward, firstly the engagement between the front portion refill engagement portion 21*a* and the front portion cartridge engagement portion 46*a* starts to be released. When the engagement on the front side of the refill 10 is released in this manner, the refill 10 (refill housing portion 11) can be swung with respect to the cartridge body 30 in a manner of raising the refill introduction portion 12. When the refill introduction portion 12 is swung in this manner, the rear portion refill engagement portion 21*b* is moved downward with respect to the rear portion cartridge engagement portion 46*b* in accordance with this swinging operation, so that the mutual abutment between the engaging flat surfaces 23*a* and 48*a* is released. Thus, the refill 10 can be smoothly detached from the cartridge body 30.

On the other hand, in the state that the staple sheet 16 exits (in a state of being filled) in the passage to the feeding passage 42 from the guide passage 18 of the refill housing portion 11 via the opening portion 26, even if the upper side face 11*a* of the refill housing portion 11 is pinched and pulled upward, the engagement between the front portion refill engagement portion 21*a* and the front portion cartridge engagement portion 46*a* is scarcely released due to the staple sheet 16 existing in the guide passage 18 and the feeding passage 42. Thus, it becomes difficult to detach the refill 10 from the cartridge body 30.

The staple sheet 16 is configured in a manner that a plurality of the straight staples are aligned in a row and the side faces of the adjacent straight staples are coupled. The adjacent straight staples thus coupled are separated by the driving operation of the driver in the electric stapler. In the case of separating (cutting) the staple sheet 16 by the power of the arm of a person, it is required to apply a power locally to the coupling portion of the straight staples in such a manner of twisting the staple sheet 16. However, even if, for example, opposite pressing forces are applied in the upper and lower direction to the entire surface of the staple sheet 16 or opposite pressing forces are applied in the opposite directions with respect to the section of the staple sheet 16 without applying a local force such as the twisting, the staple sheet can not be separated easily as compared with the case of applying a local force such as the twisting.

In particular, in the state where the staple sheet 16 exits in the passage to the feeding passage 42 from the guide passage 18 of the refill housing portion 11 via the opening portion 26, the portion of the staple sheet 16 existing in the guide passage 18 is guided by the guide upper face 15 and the guide lower face 14 of the refill introduction portion 12 and further the portion of the staple sheet 16 existing in the feeding passage 42 is guided by the staple guide 32 and the staple guide pressing portion 33 of the cartridge body 30. Thus, it is difficult to separate the staple sheet 16 at the opening portion 26 of the refill introduction portion 12 to thereby move only the tip end portion of the refill 10 upward.

The staple cartridge 1 according to the exemplary embodiment is configured in a manner that the feeding passage 42 of the cartridge body 30 is communicated with the guide passage 18 of the refill 10 in the direction different from the attachment/detachment direction (upper and lower direction in the exemplary embodiment) of the refill 10 with respect to the cartridge body 30 to thereby transfer the staple sheet 16 along these passages thus communicated. Thus, in the case where the staple sheet 16 exits in the feeding passage 42 and the guide passage 18, since the attachment/detachment of the refill 10 is restricted due to the staple sheet 16, such a phenomenon can be prevented from occurring that the refill 10 is detached from the cartridge body 30 in the state that the staple sheet 16 remains in the feeding passage 42 etc.

Further, the staple cartridge 1 according to the exemplary embodiment is configured in a manner that the engagement members (attachment/detachment members: the rear portion refill engagement portion 21*b* and the rear portion cartridge engagement portion 46*b*) for restricting the detachment of the refill 10 are formed at portions different from the portions of the refill 10 and the cartridge body 30 where the feeding passage 42 and the guide passage 18 are formed, to be more concrete, at the rear end portions thereof on the opposite side with respect to the tip end portion of the refill 10 where the guide passage 18 is formed Thus, the end portion (rear end portion), which can not prevent the detachment of the refill 10 with respect to the cartridge body 30 only by the staple sheet 16 existing in the guide passage 18, can be surely engaged, so that the refill 10 can be prevented from being detached from the cartridge body 30.

Further, the staple cartridge 1 according to the exemplary embodiment is configured in a manner that the refill 10 can be prevented from being detached from the cartridge body 30 in the state that the staple sheet 16 exists in the feeding passage 42 and the guide passage 18. Therefore, the staples can be prevented from being remained in the feeding passage 42 to thereby be able to suppress a clogging of the remained staples in the feeding passage 42.

More further, in a related-art staple cartridge in which a staple sheet is housed in a wound manner, when a refill is forcedly detached from a cartridge body, a staple in a U-shaped at a tip end of the cartridge body lodges in a feeding passage to thereby a new staple area may be pulled out for the refill. On the other hand, in the staple cartridge 1 according to the exemplary embodiment, the refill 10 can be prevented from being detached from the cartridge body 30 in the state that the staple sheet 16 exists in the feeding passage 42 and the guide passage 18. Therefore, a new staple area can be prevented from being pulled out from the refill.

Further, the refill 10 according to the exemplary embodiment is configured in a manner that the engagement members respectively formed by the front portion refill engagement portions 21*a* and the front portion cartridge engagement portions 46*a* are formed near the tip end position of the refill introduction portion 12 where the guide passage 18 is formed. Thus, even in the state that the staple sheet 16 does not exist in any of the feeding passage 42 and the guide passage 18, due to the engagement between each of the front portion refill engagement portions 21*a* and each of the front portion cartridge engagement portions 46*a*, such a phenomenon can be prevented from occurring that the tip end portion of the refill introduction portion 12 is detached from the cartridge introduction portion 39 of the cartridge body 30 unintentionally.

As described above, although the staple cartridge according to the invention is explained in detail with reference to the drawings, the staple cartridge is not limited to the one described in the aforesaid exemplary embodiment. It will be apparent that persons skilled in the art will easily think of various changes and modifications within the scope of claims and it will be understood that such changes and modifications of course belong to the technical range of the invention.

The staple cartridge according to the invention is characterized by being configured in the manner that the feeding passage of the cartridge body is communicated with the guide passage of the refill in the direction different from the attachment/detachment direction of the refill with respect to the cartridge body to thereby transfer the staple sheet along these passages thus communicated. Thus such the phenomenon can be prevented from occurring that the refill is detached in the case that the staple sheet exists in the feeding passage and the guide passage. Therefore, it is merely required that the attachment/detachment direction of the refill with respect to the cartridge body differs from the communicating direction of the feeding passage and the guide passage through which the staple sheet is guided. Thus, the invention is not limited to the configuration of the staple cartridge 1 shown in the aforesaid exemplary embodiment where the refill 10 is attached to and detached from the cartridge body 30 in the upper and lower directions with respect to the staple sheet 16 which is guided to the feeding passage 42.

Figure 8A:
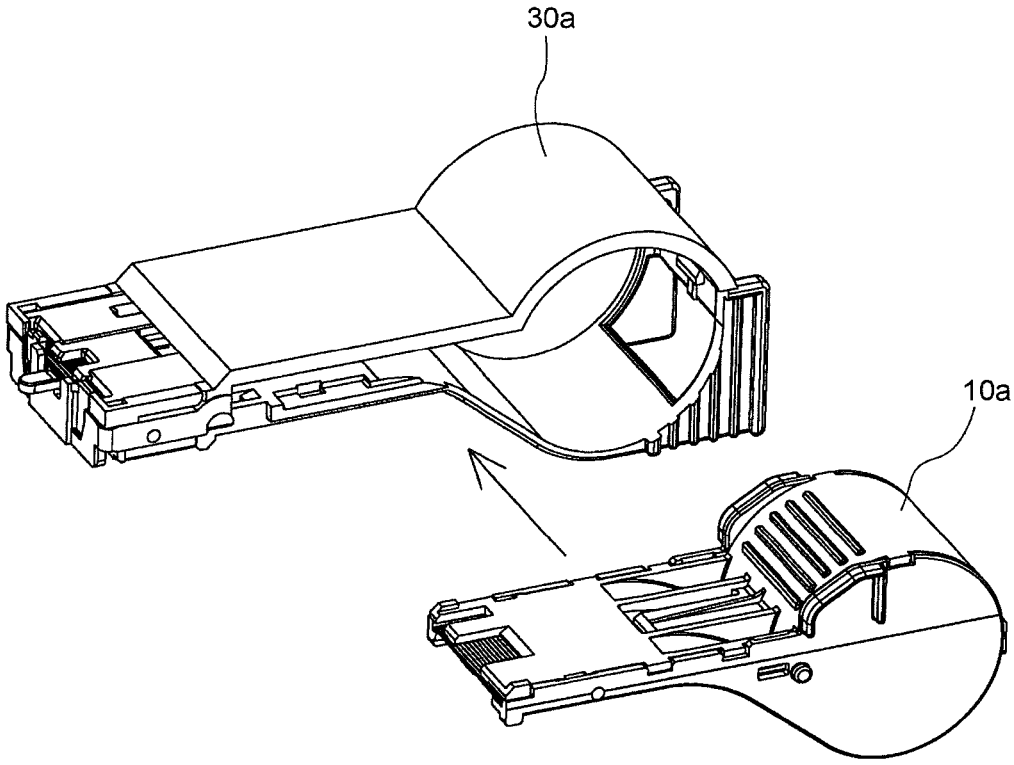
Figure 8B:
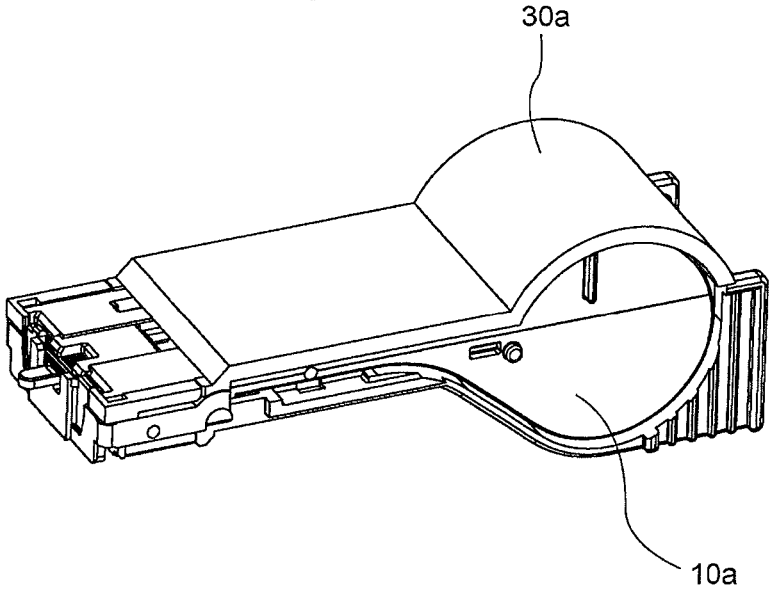

For example, as shown in FIGS. 8A and 8B, the staple cartridge may be configured in a manner that a refill 10*a* is housed in a cartridge body 30*a* from the direction perpendicular to the side sectional face of the straight staples constituting the staple sheet. Even in the case where the refill 10*a* and the cartridge body 30*a* are configured in this manner, in the case where the staple sheet exists in the feeding passage and the guide passage, the movement of the refill 10*a* to the attachment/detachment direction with respect to the cartridge body 30*a* is restricted by the staple sheet. Thus, such the phenomenon can be prevented from occurring that the refill 10*a* is detached from the cartridge body 30*a* in the state that the staple sheet remains in the feeding passage.

Further, the staple cartridge 1 according to the exemplary embodiment is explained as to the configuration that, as the attachment/detachment members, the rear portion refill engagement portion 21*b* is provided with respect to the refill housing portion 11 and the rear portion cartridge engagement portion 46*b* is provided with respect to the cartridge housing portion 38. However, the staple cartridge according to the invention is not limited to the exemplary embodiment where the attachment/detachment member is provided for each of the refill housing portion and the cartridge housing portion. The staple cartridge according to the invention may be configured in a manner that the attachment/detachment member is provided for at least one of the refill housing portion and the cartridge housing portion so that the refill housing portion can be prevented from being detached with respect to the cartridge housing portion unintentionally.

While the present inventive concept has been shown and described with reference to certain exemplary embodiments thereof, it will be understood by those skilled in the art that various changes in form and details may be made therein without departing from the spirit and scope of the invention as defined by the appended claims.

What is claimed is:

1. A staple cartridge comprising:

a refill which houses in a wound manner a staple sheet formed by coupling a plurality of straight staples and includes a guide passage for carrying out the staple sheet; and a cartridge body which includes a feeding passage for guiding the staple sheet carried out from the refill via the guide passage to a position of driving out by a driver, wherein the guide passage is communicated with the feeding passage when the refill is attached to the cartridge body, wherein the refill is attached to and detached front the cartridge body from a direction different from a direction along which the guide passage and the feeding passage are communicated, wherein the guide passage is formed by a guide upper face and a guide lower face, and wherein the cartidge body includes a cartridge housing portion which has a concave portion formed so as to correspond to the shape of the refill, the cartidge housing portion allowing the refill to swing in the concave portion when the refill is housed in the concave portion via an upper opening portion formed on an upper face side of the cartridge body.

2. The staple cartridge according to claim 1, wherein the refill includes:

a refill housing portion into which the staple sheet is housed; and a refill introduction portion extended from the refill housing portion, and wherein the guide passage is provided on the refill introduction portion.

3. A staple cartridge comprising:

a refill which houses in a wound manner a staple sheet formed by coupling a plurality of straight staples and includes a guide passage for carrying out the staple sheet; and a cartridge body which includes a feeding passage for guiding the staple sheet carried out from the refill via the guide passage to a position of driving out by a driver, wherein the guide passage is communicated with the feeding passage when the refill is attached to the cartridge body, wherein the refill is attached to and detached from the cartridge body from a direction different from a direction along which the guide passage and the feeding passage are communicated, wherein the refill further includes:

a refill housing portion which houses the staple sheet in a wound manner and has a shape expanded below; and a refill introduction portion which is extended toward a side direction from the refill housing portion to form the guide passage at a tip end thereof, wherein the cartridge body further includes:

a cartridge housing portion which has a concave portion formed so as to correspond to the expanded shape of the refill housing portion, the cartridge housing portion allowing the refill to swing in the concave portion when the refill housing portion is housed in the concave portion via an upper opening portion formed on an upper face side of the cartridge body; and a cartridge introduction portion which, when the refill introduction portion is housed therein via the upper opening portion, maintains the guide passage and the feeding passage in a communicated state to each other and suppresses a swing of the refill housing portion in the cartridge housing portion, wherein at least one of the cartridge housing portion and the refill housing portion includes an attachment/detachment member, wherein the attachment/detachment member prevents the refill from being detached from the cartridge body when the swing of the refill housing portion in the cartridge housing portion is suppressed, and wherein the attachment/detachment member allows the refill to be attached to and detached from the cartridge body when the swing of the refill housing portion in the cartridge housing portion is allowed.

4. The staple cartridge according to claim 3, wherein the attachment/detachment member prevents the refill from being detached from the cartridge body when the staple sheet exists in the feeding passage and the guide passage, and wherein the attachment/detachment member allows the refill to be attached to and detached from the cartridge body when the staple sheet does not exist in the feeding passage and the guide passage.

* * * * *